US006769930B1

(12) United States Patent
McDevitt, Jr.

(10) Patent No.: US 6,769,930 B1
(45) Date of Patent: Aug. 3, 2004

(54) CHILD PROOF OUTLET/ADAPTER APPARATUS

(76) Inventor: Charles J. McDevitt, Jr., 795 E. Hamet Pl., Tucson, AZ (US) 85737

( * ) Notice: Subject to any disclaimer, the term of this patent is extended or adjusted under 35 U.S.C. 154(b) by 0 days.

(21) Appl. No.: 10/454,082

(22) Filed: Jun. 4, 2003

(51) Int. Cl.[7] ..... H01R 13/62
(52) U.S. Cl. ..... 439/373
(58) Field of Search ..... 439/371, 372, 439/373, 353, 366, 369, 358, 148, 149

(56) References Cited

U.S. PATENT DOCUMENTS 2,932,811 A * 4/1960 Abraham et al. ..... 439/148
4,851,612 A 7/1989 Peckham ..... 174/67
5,049,086 A 9/1991 Slaven ..... 439/143
5,288,945 A 2/1994 Bruce ..... 174/67
5,348,495 A * 9/1994 Kasden ..... 439/371
6,071,142 A * 6/2000 Blackman ..... 439/373
6,428,333 B1 8/2002 Rust ..... 439/140

* cited by examiner

*Primary Examiner*—Son V. Nguyen
(74) *Attorney, Agent, or Firm*—Sturm & Fix LLP

(57) ABSTRACT

A childproof outlet/adapter apparatus (10) to prevent a child from removing a plug (100) from an electrical receptacle (50) wherein, the apparatus (10) includes a generally flat cover plate member (20) having an enlarged receptacle opening (21) flanked by a pair of toothed apertures (23) (23) which captively engage a plug adapter member (30) having a pair of leg elements (31) (31) wherein each leg element (31) includes a pair of spaced flexible leg segments (32) (32) adapted to be releasably engaged in the toothed apertures (23) (23) and further including a base element (35) that is connected to the leg elements (31) (31) and is adapted to captively surround the electrical cord (101) adjacent to the plug (100).

6 Claims, 1 Drawing Sheet

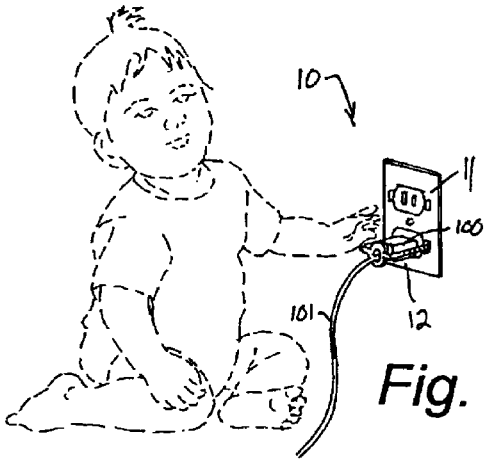
Fig. 1
Fig. 2
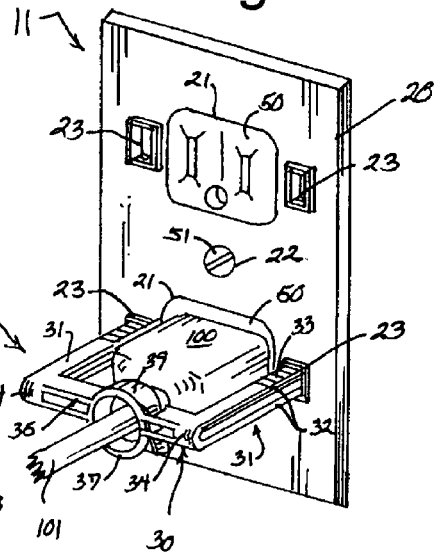
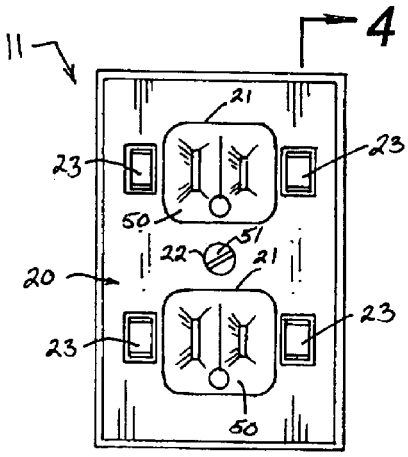
Fig. 3
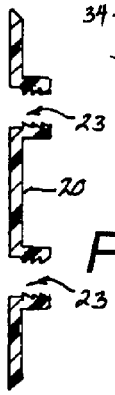
Fig. 4
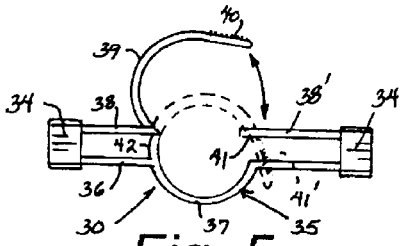
Fig. 5
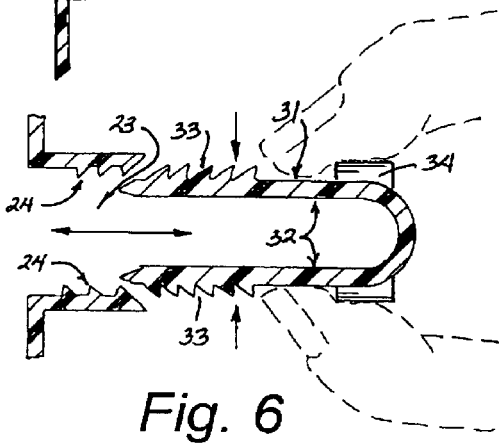
Fig. 6

CHILD PROOF OUTLET/ADAPTER APPARATUS

CROSS REFERENCE TO RELATED APPLICATIONS

This invention was the subject matter of Document Disclosure Program Registration No. 52637, filed in the U.S. Patent and Trademark Office on Feb. 21, 2003.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of child resistant safety receptacles in general and in particular to a modified receptacle and plug adapter that is adapted to releasably engage both the plug and the modified receptacle.

2. Description of Related Art

As can be seen by reference to the following U.S. Pat. Nos. 4,851,612; 5,049,086; 5,288,945; and, 6,428,333, the prior art is replete with myriad and diverse child proof electrical plug safety arrangements and to prevent a child from removing a plug from engagement with an electrical receptacle.

While all of the aforementioned prior art constructions are more than adequate for the basic purpose and function for which they have been specifically designed, they are uniformly deficient with respect to their failure to provide a simple, efficient, and practical outlet/adapter apparatus that involves only minimal modification to an existing receptacle outlet and an adapter designed to releasably engage both a conventional electrical plug and the modified adapter.

Unfortunately, virtually all of the prior art solutions involve structurally complex and expensive approaches to a problem that is encountered by all parents of young children whose innate curiosity invariably draws them to electrical outlets with potentially devastating results.

As a consequence of the foregoing situation, there has existed a longstanding need for a new and improved child-proof outlet/adapter apparatus that is inexpensive to produce and which requires only minor modifications to conventional receptacle cover plates; and the provision of such a construction is a stated objective of the present invention.

BRIEF SUMMARY OF THE INVENTION

Briefly stated, the outlet/adapter apparatus that forms the basis of the present invention comprises in general an outlet cover unit and plug adapter unit.

As will be explained in greater detail further on in the specification, the outlet cover unit comprises a generally flat cover plate member provided with a plurality of enlarged receptacle openings wherein, each receptacle opening is flanked by a pair of toothed apertures.

In addition, the plug adapter unit comprises a generally U-shaped adapter member including a pair of inwardly directed leg elements connected together by a base element wherein, each leg element includes a pair of spaced flexible leg segments that is adapted to be captively received in said toothed apertures.

Furthermore, the base element comprises an upper and a lower support arm both having arcuate central portions adapted to encircle an electrical cord attached to an electrical plug wherein, one of the arcuate central portions includes a hinged arcuate flap that accepts the insertion of the cord between the upper and low r support arms; wherein, the free end of the hinged flap is adapted to captively engage one of the support arms to surround the electrical cord to prevent the plug from being removed from the receptacle by a child.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the outlet/adapter apparatus that forms the basis of the present invention in use;

FIG. 2 is an isolated perspective view showing a single plug engaged in the outlet cover unit wherein, a plug adapter unit engages both the plug and the outlet cover unit;

FIG. 3 is a front plan view of the outlet cover unit;

FIG. 4 is a cross-sectional view taken through line 4—4 of FIG. 3;

FIG. 5 is a front plan view of the plug adapter unit;

FIG. 6 is a cross-sectional view illustrating the engagement of one of the adapter prongs with one of the toothed apertures in the cover unit.

DETAILED DESCRIPTION OF THE INVENTION

As can be seen by reference to the drawings, and in particularly to FIG. 1, the outlet/adapter apparatus that forms the basis of the present invention is designated generally by the reference number 10. The apparatus 10 comprises in general an outlet cover unit 11 and a plug adapter unit 12. These units will now be described in seriatim fashion.

As can best be appreciated by reference to FIGS. 2 through 4, the outlet cover unit 11 comprises a generally flat modified conventional receptacle cover plate member 20 having a plurality of enlarged receptacle openings 21 adapted to receive a like plurality of conventional electrical receptacles 50 and at least one discrete mounting aperture 22 dimensioned to receive a threaded fastener 51 for mounting the receptacle cover plate member 20 to a receiver outlet box (not shown) in a well recognized fashion.

The modifications to the conventional receptacle cover plate member 20 comprise pairs of toothed apertures 23 23 disposed in a flanking relationship relative to each of the plurality of enlarged receptacle openings 21 in the cover plate member 20 for reasons that will be explained in greater detail further on in the specification.

Turning now to FIGS. 1, 2, 5, and 6, it can be seen that the plug adapter unit 12 comprises a generally U-shaped plug adapter member 30 having a pair of inwardly directed leg elements 31 31 wherein, each leg element 31 is provided with a pair of spaced flexible leg segments 32 32 the exterior distal ends of which are provided with toothed ridges 33 and the proximal ends of which are secured in a spacer element 34 for reasons that will be explained presently.

As can best be appreciated by reference to FIGS. 2 and 6, the toothed ridges 33 on the flexible leg segments 32 32 are adapted to releasably engage the teeth 24 of the toothed apertures 23 in the cover plate member 20 whereby the flexible leg segments 32 32 may be flexed toward one another to disengage the leg segments 32 from the cover plate member 20 in a well recognized fashion.

In addition, as shown in FIGS. 2 and 5, the pair of leg elements 31 31 of the plug adapter member 30 are operatively connected to one another by a base element 35 having a lower support arm 36 having a downwardly depending arcuate central portion 37 and an upper support arm 38 having a central arcuate flap 39 hingedly connected to one side of the upper support arm 38 wherein, the free end of the flap 39 is dimensioned to pass through a discrete aperture 41 formed on the other side of the upper support arm 38' and further provided with a ridged surface 40 that will be captively engaged in the discrete aperture 41 in the upper support arm 38' and through an optional aperture 41' formed in the lower support arm 36.

Furthermore, at least one arcuate cross brace 42 extends between the arcuate central portions 37 39 of the upper 38 and lower 36 support arms which cooperate with the arcuate flap 39 to form a closed loop that captively surrounds the cord 101 of an electrical plug 100 to captively engage the plug 100 in a receptacle 50 when the leg elements 31 31 of the plug adapter member 30 are engaged in the toothed apertures 23 23 on both sides of the receptacle 50.

By now it should be appreciated that once the outlet/adapter apparatus is installed, the only way that the plug 100 can be removed from the receptacle 50 is by simultaneously grasping and pinching together each of the flexible leg segments 32 of each leg element 31 to disengage the teeth 33 23 from one another to permit the extraction of the plug 100 from the receptacle 50.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A childproof outlet adapter apparatus for securing an electrical plug having a cord in an electrical receptacle the apparatus comprising:

outlet cover unit including a generally flat cover plate member having at least one enlarged receptacle opening that is flanked by a pair of toothed apertures;

a plug adapter unit including a generally U-shaped plug adapter member having a pair of inwardly directed leg elements that are connected to one another by a base element wherein distal ends of the leg elements are be releasably received in said pair of toothed apertures;

wherein, said base element is provided with a central portion releasably surround the outer periphery of the cord to secure the plug in said electrical receptacle; and each of said leg elements comprises a pair of spaced flexible leg elements, and an exterior distal end of each of said flexible leg segments is provided with toothed ridges to operatively engage with a corresponding toothed aperture, and each pair of spaced leg segments is secured in a spacer element that is attached on one of opposite ends of the base element.

2. The apparatus as in claim 1, wherein the base element includes a lower support arm and an upper support arm.

3. The apparatus as in claim 2, wherein one of said upper and lower support arms is provided with an arcuate central portion.

4. The apparatus as in claim 3, wherein the other of said upper and lower support arms is provided with an arcuate flap.

5. The apparatus as in claim 4, wherein said arcuate flap is adapted to be releasably engaged with the one of said upper and lower support arms.

6. The apparatus as in claim 2, wherein said upper and lower support arm is connected to one another by at least one cross-brace.

* * * * *